United States Patent [19]

Rouf

[11] 4,292,498

[45] Sep. 29, 1981

[54] HIGH VOLTAGE ELECTRODE STEAM BOILER AND ELECTRODE ASSEMBLY THEREFOR

[75] Inventor: Mohammad A. Rouf, Kewanee, Ill.

[73] Assignee: Kewanee Boiler Corporation, Kewanee, Ill.

[21] Appl. No.: 73,282

[22] Filed: Sep. 7, 1979

[51] Int. Cl.[3] ..... H05B 3/60; F22B 1/30

[52] U.S. Cl. ..... 219/288; 219/275; 219/291; 338/80

[58] Field of Search ..... 219/271–276, 219/284–295; 338/80–86; 122/13 A, 4 A

[56] References Cited

U.S. PATENT DOCUMENTS

| | | | |
|---|---|---|---|
| 1,466,013 | 8/1923 | Buchli | 219/294 |
| 1,688,201 | 10/1928 | Neall et al. | 219/294 |
| 1,688,202 | 10/1928 | Neall et al. | 219/288 |
| 2,088,932 | 8/1937 | Stalhane | 219/288 X |
| 2,676,240 | 4/1954 | Eaton | 219/285 |
| 2,783,356 | 2/1957 | Eaton | 219/290 |
| 4,051,345 | 9/1977 | Eaton | 219/285 |

FOREIGN PATENT DOCUMENTS 632231 7/1936 Fed. Rep. of Germany ..... 219/288

*Primary Examiner*—A. Bartis

*Attorney, Agent, or Firm*—James T. FitzGibbon

[57] ABSTRACT

An electrode assembly for an electrode boiler employing electric current flow between spaced electrode assemblies immersed in an electrically conductive fluid in a boiler vessel for raising the temperature of the fluid includes an upright electrode member having an internal flow passage terminating in outlet slots in the outer peripheral surface of the bottom portion of the electrode member. The conductive fluid is pumped under pressure through the internal passage and exits through the slots into contact with fluid guide vanes on the electrode member and surrounding the bottom portion thereof. The guide vanes, which may be cupped-shaped or curved, are arranged in the path of the fluid exiting the outlet slots and create fluid circulation adjacent to outer peripheral surface of the electrode member to remove steam bubbles therefrom for the prevention of detrimental arcing.

22 Claims, 9 Drawing Figures

32
36
32
2
1
33
33
2
2
35
34
21
20
20
3
41
41
24
26
19
18
12
10
12
10
5
11
13
18
11
13
4
8
6
8
8
7

HIGH VOLTAGE ELECTRODE STEAM BOILER AND ELECTRODE ASSEMBLY THEREFOR

BACKGROUND OF THE INVENTION

This invention relates in general to boilers, and, in particular, to an electrode assembly for use in electric boilers.

More specifically, but without restriction to the particular use which is shown and described, this invention relates to an improved electrode for an electric boiler, employing a forced water flow about the electrode periphery to minimize the formation of gas bubbles.

In one well known form of boiler for heating water and producing steam, an electrical current is directed from one or more electrodes through surrounding water to generate heat. The generated heat raises the water temperature to a predetermined level in the case of hot water boilers, and converts the water into steam in steam boilers. One type of electric boiler of the prior art employs a neutral shield in conjunction with the electrode causing the maximum voltage gradient to occur at the surface of the electrode. If the voltage gradient at the electrode surface is high or equal to the breakdown voltage of the water contained in the boiler, then arcing may occur. Arcing erodes the electrode surface to affect adversely its length of service. Generally, arcing associated with the formation of maximum voltage, can be alleviated by properly selecting the size of the electrode and the neutral shield in relation to the boiler water conductivity, breakdown voltage, power output, and supply voltage.

In addition to the maximum voltage gradient forming at the electrode surface, severe arcing may also arise when steam bubbles are formed on or adjacent the surface of the electrode. Since steam has a much greater electrical resistivity compared to water, the formation of steam bubbles can arrest most of the voltage between the electrode and neutral shield and seriously interfere with the operation of the boiler itself. When the voltage difference across the steam bubbles is equal to or higher than the breakdown voltage, detrimental arcing will take place across the bubble. The electrodes utilized in prior art electric boilers have been highly ineffective in eliminating or removing the steam bubbles from the electrode surface for prevention of the arcing problem.

SUMMARY OF THE INVENTION

It is, therefore, an object of this invention to improve electric boilers.

Another object of this invention is to remove steam bubbles from the vicinity of the surface of an electrode of an electric boiler.

A further object of this invention is to circulate water in the vicinity of the electrode surface of the boiler to remove steam bubbles.

Still another object of the invention is to circulate water in the vicinity of the electrode surface through the use of guide vanes.

These and other objects are attained in accordance with the present invention wherein there is provided an electric boiler in which a forced circulation of water in the vicinity of the surface of the electrode means is employed to remove steam bubbles from the surface thereof. The circulation of water is guided through vane means operatively coupled to the electrode means to create a flow of water to remove the steam bubbles. The forced circulation of water against the surface of the electrode means as accomplished by the invention herein disclosed significantly overcomes the arcing problems previously encountered in the use of electric boilers.

DESCRIPTION OF THE DRAWINGS

Further objects of the invention, together with additional features contributing thereto, and advantage accruing therefrom, will be apparent in the following description of the preferred embodiments of the invention which are shown in the accompanying drawings wherein like reference numerals indicate corresponding parts throughout, wherein.

DESCRIPTION OF THE PREFERRED EMBODIMENTS OF THE INVENTION

Figure 1:
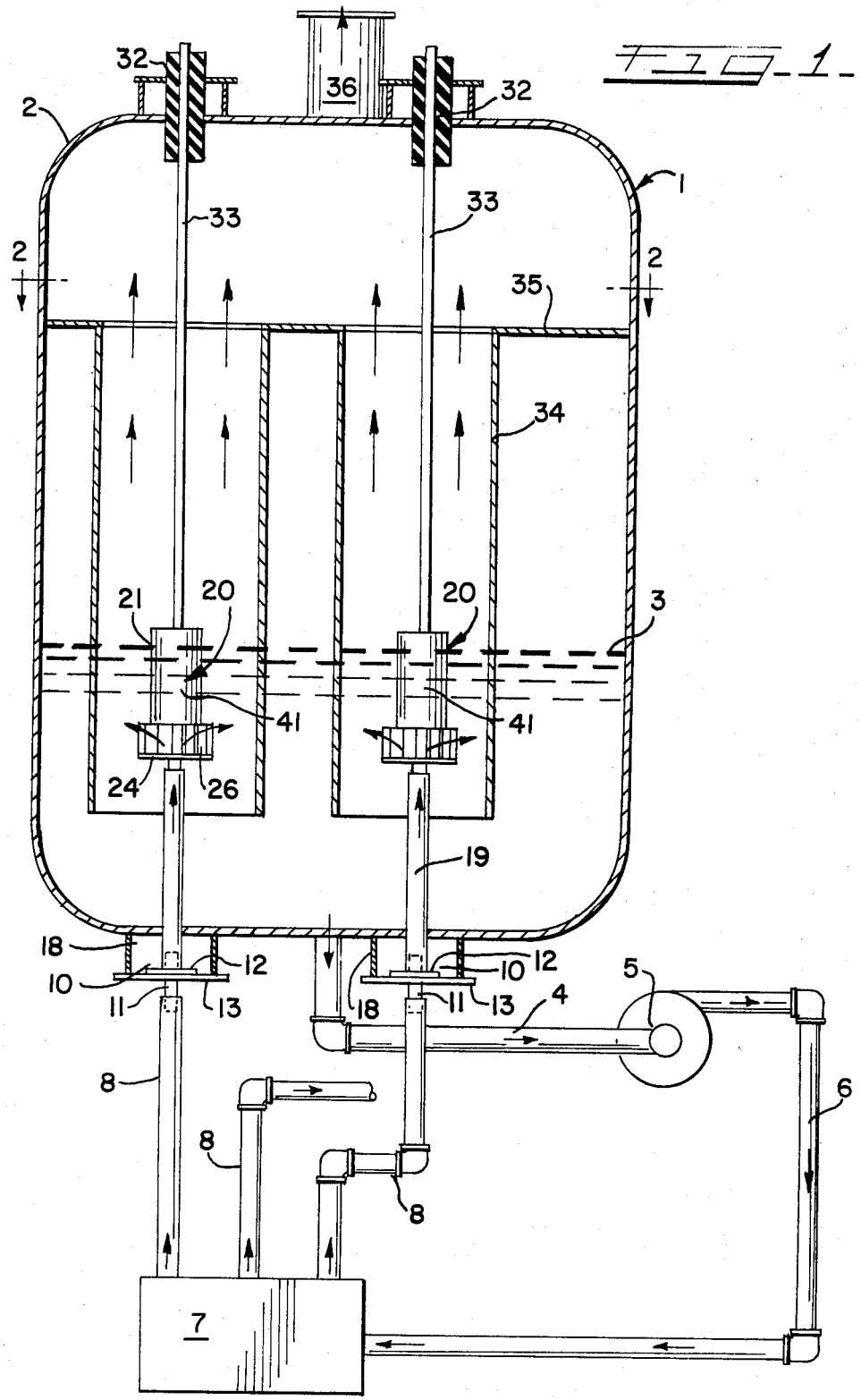
FIG. 1 is a schematic side view, with parts in section, of an electric boiler employing the improved electrode assembly of the invention.
Figure 8:
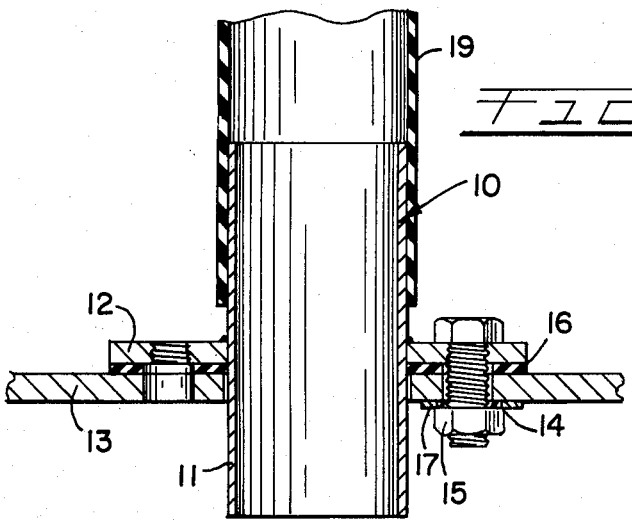
FIG. 8 is a sectional view, to an enlarged scale, of the feed-through device of the electric boiler of FIG. 1.

Although not intended to be so limited, the improved electrode assembly of the invention is described with reference to its use in a high voltage electric boiler for generating steam. The electrode assembly can also be used in conjunction with hot water heaters or in other applications where arcing caused by the formation of steam bubbles is encountered. Referring now to FIGS. 1–5, there is illustrated an electric boiler employing one embodiment of the improved electrode assembly of the invention. Electric boiler 1 includes a vessel 2 containing a selected level of water through which an electric current is passed to raise the temperature of the fluid and, for example, generate steam. In FIG. 1 the level of water within vessel 2 is shown generally by reference number 3. The water level introduced into the vessel 2 is maintained through a water circulation system having a recirculating outlet pipe 4 connected to the bottom wall of the vessel. Water is drawn from the vessel by means of a recirculating pump 5 which delivers the fluid via a pipe 6 to a distribution header 7. Make-up water may be introduced into the water circulation system as needed by any technique (not shown). The electric boiler shown in FIG. 1 utilizes three distribution lines 8 for introducing water into vessel 2 in a manner to be described. Each of the three distribution lines 8 are coupled to the interior of vessel 2 by means of a respective feed-through assembly 10 as best illustrated in FIGS. 1 and 8. Although only two feed-through assemblies 10 are shown in FIG. 1, it should be apparent to one skilled in the art that the third distribution line 8 is also connected to vessel 2 by the identical means as the illustrated pair of lines.

Referring now in particular to FIG. 8, there is illustrated one of the feed-through assemblies 10 which includes a pipe-like, feed-through nipple 11 having an upper flange 12 suitably affixed to the exterior thereof, such as, by welding, or the like. The flange 12 is positioned in confronting relationship to a flange cover 13 and is physically coupled thereto by a plurality of circumferentially disposed bolts 14 and associated locking nuts 15. A rubber gasket 16 is suitably interposed between the lower surface of flange 12 and the upper surface of flange cover 13 while a rubber gasket with washer 17 is situated between each of the nuts 15 and the lower surface of flange cover 13. A cylindrical casing carrying a flange 18, as best shown in FIG. 1, is mounted with flange cover 13 and is suitably affixed to the bottom of vessel 2. The upper end of feed-through nipple 11 of each of assemblies 10 is connected in sealed relationship to a conduit 19 in the form of a rubber hose which extends upwardly through three respective ports in vessel 2 and upward to supply water under pressure to a respective one of a plurality of electrodes mounted within vessel 2. In the boiler shown in FIGS. 1 and 2, three electrode assemblies are employed to pass electric current through the water contained in the vessel to raise the temperature thereof. It is within the scope of the invention, however, to use other numbers of electrodes dependent on desired results.

Figure 4:
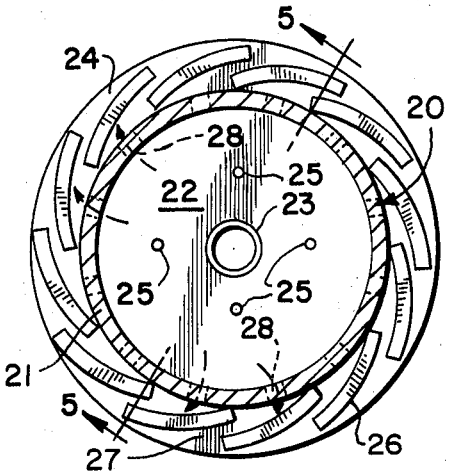
FIG. 4 is a top sectional view taken along line 4—4 of FIG. 3.
Figure 3:
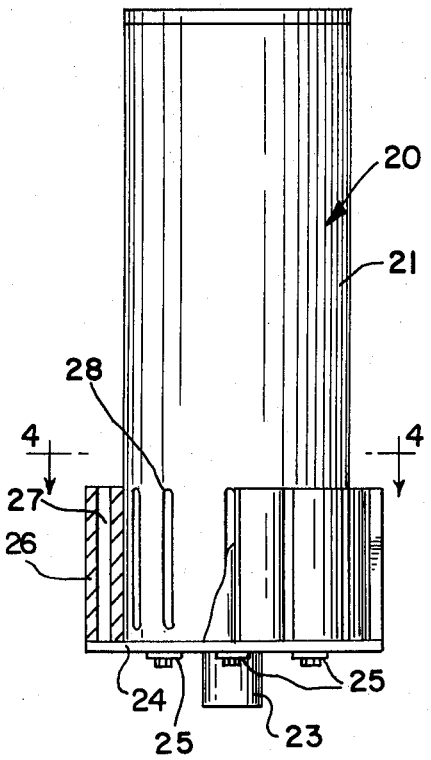
FIG. 3 is a side schematic view, to an enlarged scale, with parts in section of one embodiment of the improved electrode assembly of the invention.
Figure 5:
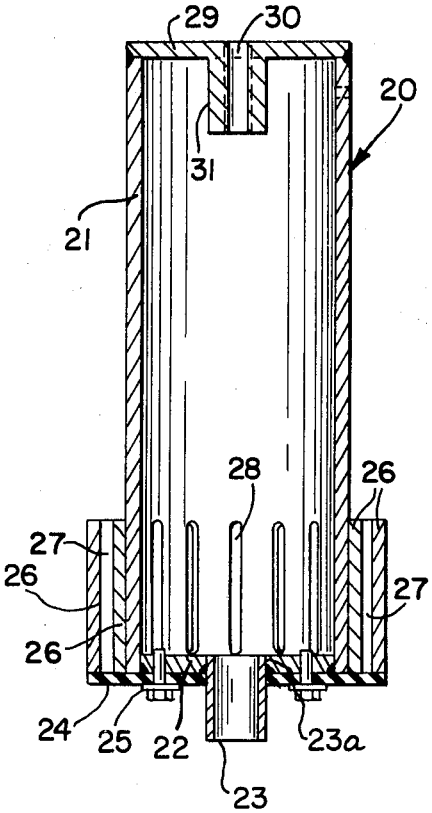
FIG. 5 is a side sectional view of the improved electrode assembly taken along line 5—5 of FIG. 3.

Referring now to FIGS. 3, 4, and 5, there is illustrated one embodiment of the improved electrode assembly 20 of the invention. The electrode assembly comprises a hollow metallic pipe-like member 21 having a bottom cover 22 through which an inlet conduit 23 is disposed in part in an opening 23*a* therein. Inlet conduit 23 is coupled to the upper end of rubber hose 19 to introduce water under pressure to electrode 20 as best shown in FIG. 1. Each of the electrode assemblies 20 is provided with a bottom electrical insulator in the form of a disc 24 coupled to the bottom cover 22 by means of a plurality of screws 25. Insulator 24 may be fabricated from any suitable electrical insulating material, such as, for example, a silicone rubber.

A plurality of metallic electrode guide vanes 26 are attached in surrounding relationship to the lower periphery of electrode pipe 21 with their bottom edges in substantial contact with insulator 24. Although the guide vanes 26 are shown in FIGS. 3 and 5 as extending only a portion of the height of electrode pipe 21, it is within the scope of the invention to utilize guide vanes which extend the entire height of the electrode when appropriate under certain encountered conditions. The guide vanes 26 are in the form of a plurality of spaced curved vane members defining a plurality of water flow passages 27 therebetween. Each of the flow passages 27 is in fluid communication with a respective longitudinally extending slot 28 formed in the sidewall of pipe 21 to direct flow from within electrode pipe 21 through vanes 26.

Figure 2:
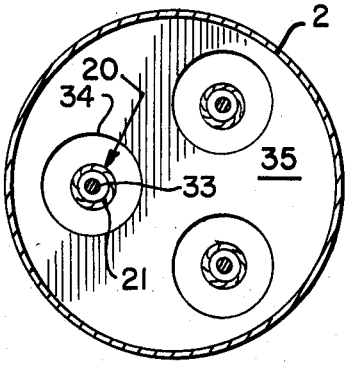
FIG. 2 is a top sectional view taken along line 2—2 of FIG. 1.

The upper end of electrode pipe 21 is attached to an electrode rod adaptor 29 having a central passage 30 defined by a central protrusion 31 integrally formed with the adaptor 29. For each of the three electrode assemblies 20 situated in vessel 2, a respective electrode head insulator bushing 32 is disposed at the top of vessel 2 through which an electrode rod 33 passes downwardly into the vessel 2. The threaded end (not shown) of rod 33 engages the interior threads of opening 30 (FIG. 4) to create electrical coupling therebetween. The electrode rod 33 comprises a suitable metallic electrical conductor having an external covering of electrical insulating material. The rod 33 is coupled to a suitable source of high voltage electrical potential (not shown) to direct an electrical current from electrode pipe 21, in conjunction with a tubular neutral shield 34 disposed in circumferential surrounding relationship to each electrode 20, as best shown in FIGS. 1 and 2, into the surrounding water and elevate the temperature thereof.

During operation of the steam boiler 1, the pump 5 creates a pressurized circulation of water through distribution header 7, each of the pipes 8, and into the interior of a respective electrode assembly 20. The water under pressure introduced into electrode pipe 21 is thus caused to be forced outward through passages 27 between vanes 26 to create a swirling circulation of flow about the periphery of the electrode 20. The water guided through each electrode passage 27 will pass over the adjacent vane and scrub away any steam bubbles from the electrode surface in the vicinity of the vanes. The upper part of the electrode pipe 21 extending above vanes 26 is subjected to a washing action by the moving steam due to the agitation created as steam bubbles move upward from the bottom part of the electrode. For these reasons, it has been found that it is only necessary to position vanes 26 at the lower portion of electrode pipe 21 where the scrubbing action is employed. Steam produced by the heated water within the confines of neutral shields 34 rises upward through ports in steel diaphragm 35 for egress from steam supply port 36.

Figure 6:
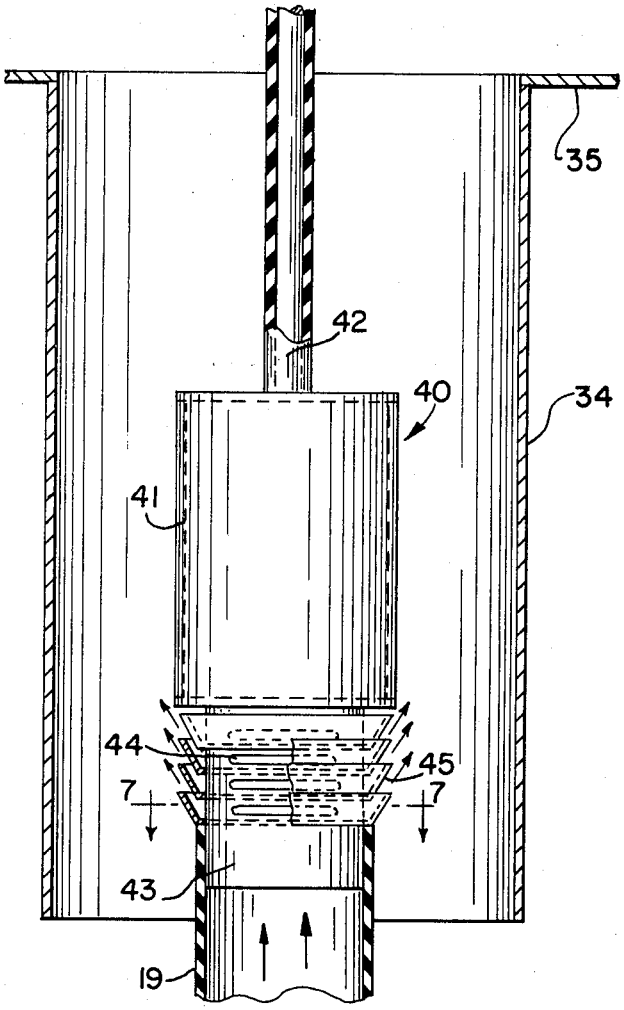
FIG. 6 is a side schematic view, to an enlarged scale, with parts in section, of another embodiment of the electrode assembly of the invention.
Figure 7:
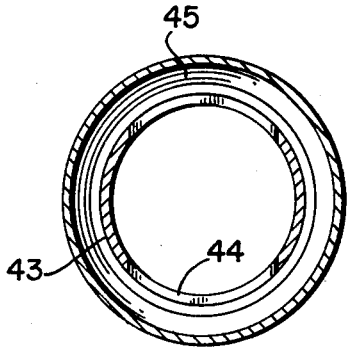
FIG. 7 is a top sectional view taken along line 7—7 of FIG. 6.

Referring to FIGS. 6 and 7, there is illustrated another embodiment of the improved electrode assembly of the invention for use in the electric boiler 1, shown in FIG. 1. Electrode assembly 40 includes an upper electrode body 41 in the form of a hollow metallic pipe to an electrically insulated electrode rod 42 in a manner similar as that previously described with reference to the embodiment of FIGS. 3–5. The lower portion 43 of electrode body 40 is an additional metallic hollow member having a smaller diameter than the upper portion 41. Upper and lower portions 41 and 43 are coupled to form an interior electrode chamber to which water under pressure is supplied by rubber hose 19 coupled to lower portion 43 as previously described. A plurality of laterally extending slots 44 are provided in the wall of lower electrode member 43 and directs water under pressure against a plurality of cup guide vanes 45 coupled to lower member 43, which divert the water upward adjacent the electrode surface. Water guided by each of the cup guide vanes 45 will pass over the next vane as it passes therethrough, to wash away steam bubbles and to prevent their formation in a similar manner as that described with reference to the assembly shown in FIGS. 3–5.

Figure 9:
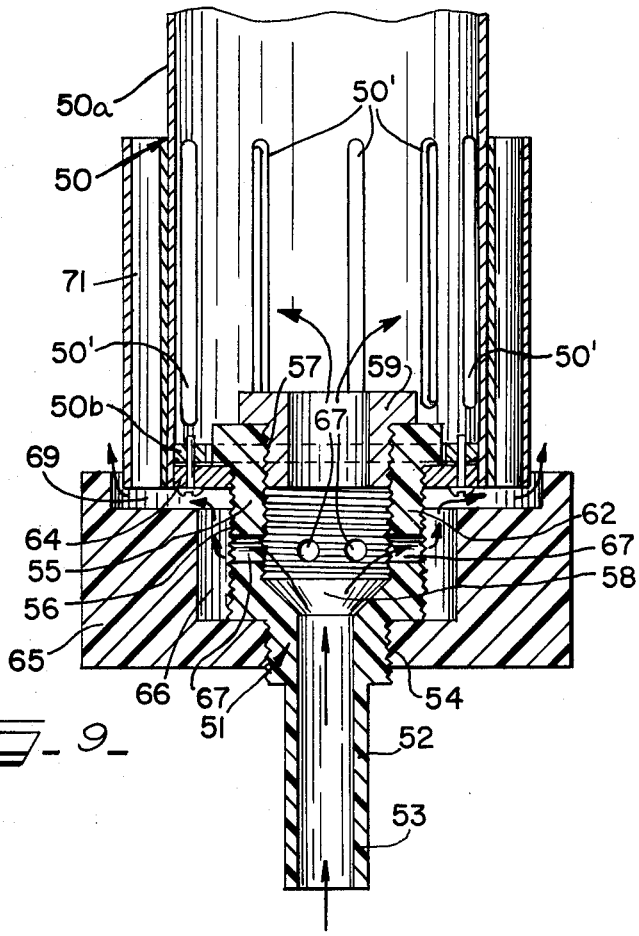
FIG. 9 is a side sectional view of still another embodiment of the electrode assembly of the invention.

Referring now to FIG. 9, there is illustrated still another embodiment of the improved electrode assembly of the invention for use in an electric boiler such as shown in FIG. 1. The embodiment of FIG. 9 has proved to be highly satisfactory in the prevention of the formation of steam bubbles and is capable of a long length of service in operation in a steam boiler. The embodiment as shown in FIG. 9 includes an electrode assembly 50 having a metallic electrode pipe 50*a* to which an electrode annular-like bottom 50*b* is suitably affixed, such as, by welding, and the like. The electrode bottom is adapted to receive a portion of a flow distributor 51 within its central opening.

Flow distributor 51 of an electrically insulative material is provided with a nipple 53 for coupling the hose of the water circulating system to introduce water under pressure into the electrode body. Flow distributor 51 further includes an intermediate threaded outer portion 54 and an upper body 55 of enlarged diameter having external threads 56 and internal threads 57. The flow distributor possesses a flow passage 58 in fluid communication to the interior of electrode 50 through distributor plug 59 which is in threaded coupling with interior threads 57. The external threads 56 of the flow distributor 51 engage corresponding threads of a flow distributor adaptor 62 which is attached by means of a plurality of screws to electrode bottom **50*b***.

A cup-like electrode protector 65 fabricated from an electrically insulating material such as Teflon embraces the upper portion of distributor 51 and is attached thereto through intermediate threads 54 thereof. The upper portion of electrode protector 65 creates a fluid chamber 66 in surrounding relationship to the upper portion of fluid distributor 51 which fluid chamber is in fluid communication with the interior of the fluid distributor 51 through a plurality of ports 67. The outer upper portions of electrode protector 65 are spaced from the bottom of the electrode pipe **50*a* to form an outlet passage 69 in communication with fluid chamber 66. Thus, a portion of water supplied to electrode 50 is directed through ports 67, chamber 66, and upward past the periphery of electrode pipe 50*a*. In addition, as shown by the arrows in FIG. 9, the flow distributor 51 directs water into the interior of the electrode pipe 50*a* which is provided with a plurality of slots 50' to permit a flow to be directed through a plurality of guide vanes 71 of the type of vanes, for example, shown as vanes 26 in FIGS. 2 to 5 in the previously described embodiment. Thus, it should be apparent that the multiple flow paths adjacent to electrode 50*a* and electrode vanes 71** scrubs steam bubbles in a similar manner as described with reference to the previously disclosed embodiments.

While the invention has been described with reference to several preferred embodiments, it will be understood by those skilled in the art that various changes may be made and equivalents may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. An electrode boiler comprising boiler means for receiving a quantity of electrically conductive fluid, an electrode positioned within said boiler means and adapted to be coupled to a source of electrical potential for directing electrical current through the quantity of fluid to raise the temperature thereof, said electrode having an internal flow passage and an outer peripheral surface, said flow passage being provided with outlet means in said peripheral surface, fluid supply means coupled to said internal flow passage for supplying fluid under pressure to said internal flow passage, and said electrode further including fluid guide means arranged with respect to said peripheral surface of said electrode in the path of fluid exiting from said outlet means for causing fluid circulation adjacent said outer peripheral surface of the electrode to remove steam bubbles therefrom during the heating of the quantity of fluid within said boiler means.

2. The electrode boiler of claim 1 wherein said electrode is a hollow member mounted upright in said boiler means.

3. The electrode boiler of claim 2 wherein said fluid supply means include a conduit coupled to the bottom of said electrode.

4. The electrode boiler of claim 2 wherein said outlet means includes a slot creating fluid communication between the internal flow passage and the outer peripheral surface of the electrode.

5. The electrode boiler of claim 4 wherein said fluid guide means includes at least one guide vane for circulating fluid relative to the outer peripheral surface of the electrode

6. The electrode boiler of claim 5 wherein a plurality of guide vanes are provided to circulate fluid around the electrode.

7. The electrode boiler of claim 5 wherein said at least one guide vane circulates fluid relative to the electrode with a swirling component.

8. The electrode boiler of claim 7 wherein said at least one guide vane possesses a curved configuration.

9. The electrode of claim 5 wherein said at least one guide vane includes a cup-shaped configuration.

10. The electrode of claim 5 wherein said fluid supply means include fluid distributor means coupled to said electrode, said fluid supply means having port means to direct a portion of said fluid under pressure about said outer peripheral surface of said electrode.

11. The electrode of claim 10 wherein said outlet means includes port means for directing a portion of said fluid under pressure from said flow passage to said peripheral surface of the electrode.

12. The electrode boiler of claim 1 wherein fluid guide means is mounted in surrounding relationship to the electrode.

13. The electrode boiler of claim 12 wherein said electrode is mounted upright in said boiler means, and said fluid guide means surround the bottom portion of the electrode.

14. The electrode boiler of claim 1 further including a second electrode positioned in said spaced relationship to said electrode.

15. The electrode boiler of claim 1 further including a shield member mounted within said boiler means in spaced relationship to said electrode.

16. An electrode for a boiler employing electrical energy to raise the temperature of an electrically conductive fluid therein comprising an electrode member for directing electrical current to surrounding fluid from the periphery thereof, said electrode member having internal fluid passage and an outer peripheral surface, said fluid passage being provided with outlet means in said peripheral surface, vane means mounted on said electrode member and positioned within the path of fluid exiting from said outlet means, and fluid supply means in fluid communication with said fluid passage for directing fluid under pressure through said passage and outlet means to said vane means to circulate fluid adjacent to the periphery of said electrode means and remove steam bubbles adjacent thereto.

17. The electrode according to claim 16 wherein said electrode member is a hollow tubular element.

18. The electrode according to claim 17 wherein said outlet means includes a plurality of slots to direct fluid under pressure from said internal flow passage to said vane means.

19. The electrode according to claim 18 wherein said tubular element is uprightly disposed.

20. The electrode according to claim 19 wherein said fluid supply means is coupled to the bottom of the tubular element.

21. The electrode of claim 16 wherein said vane means includes a plurality of vanes.

22. The electrode of claim 16 wherein said fluid supply means directs fluid under pressure about the periphery of said electrode member adjacent to said vane means.

* * * * *